US008708203B2

(12) United States Patent
Laible

(10) Patent No.: US 8,708,203 B2
(45) Date of Patent: Apr. 29, 2014

(54) SCREW-ON THROAT PLUG ASSEMBLY

(75) Inventor: Rodney Laible, Omaha, NE (US)

(73) Assignee: RL Innovations, LLC, Omaha, NE (US)

( * ) Notice: Subject to any disclaimer, the term of this patent is extended or adjusted under 35 U.S.C. 154(b) by 0 days.

(21) Appl. No.: 13/465,111

(22) Filed: May 7, 2012

(65) Prior Publication Data

US 2013/0292424 A1 Nov. 7, 2013

(51) Int. Cl.
*B65D 49/08* (2006.01)

(52) U.S. Cl.
USPC ..... 222/481.5; 222/464.1; 222/511; 222/518; 222/496; 222/546; 222/559

(58) Field of Classification Search
USPC ..... 222/479, 478, 546, 481, 464.1, 513, 222/518, 559, 561, 562, 511, 481.5, 497, 222/496, 137
See application file for complete search history.

(56) References Cited

U.S. PATENT DOCUMENTS 1,387,211 A * 8/1921 Sweeny ..... 222/539
2,913,749 A 3/1958 Ayres
2,849,163 A 8/1958 Soffer et al.
3,556,353 A 1/1971 Echols
3,951,293 A 4/1976 Schulz
4,159,790 A 7/1979 Bailey
4,401,272 A 8/1983 Merten et al.
4,445,539 A 5/1984 Credle
4,564,117 A 1/1986 Herbert
4,646,945 A 3/1987 Steiner et al.
4,673,404 A 6/1987 Gustavsson
4,722,450 A 2/1988 Mario
4,832,237 A * 5/1989 Hurford, Jr. ..... 222/464.1
4,862,918 A 9/1989 Schroeder
4,863,051 A 9/1989 Elbner et al.
4,875,603 A 10/1989 Weinstein
4,886,193 A 12/1989 Wassilieff
4,967,922 A 11/1990 Alder
RE33,539 E * 2/1991 Karpal ..... 222/482
5,048,705 A 9/1991 Lynd et al.
5,048,723 A 9/1991 Seymour
5,082,150 A 1/1992 Steiner et al.
5,107,909 A 4/1992 Donovan
5,165,578 A 11/1992 Laible
5,232,110 A 8/1993 Purnell
5,275,310 A 1/1994 Mielnik et al.
5,350,091 A 9/1994 Leete et al.
5,368,205 A 11/1994 Groh
5,413,152 A 5/1995 Burrows
5,472,124 A 12/1995 Martushev
5,529,223 A 6/1996 Fisher
5,588,565 A 12/1996 Miller
5,645,192 A 7/1997 Amidzich
5,803,311 A 9/1998 Fuchs
5,890,517 A * 4/1999 Laible ..... 137/614.04
5,988,456 A * 11/1999 Laible ..... 222/464.1
6,062,435 A 5/2000 Hess, III
6,142,345 A * 11/2000 Laible ..... 222/189.1

(Continued)

*Primary Examiner* — Frederick C Nicolas
*Assistant Examiner* — Michael J Melaragno
(74) *Attorney, Agent, or Firm* — Dennis L. Thomte; Thomte Patent Law Office LLC

(57) ABSTRACT

A screw-on throat plug assembly for use in a closed loop dispensing system. The throat plug assembly also includes a mechanical venting assembly which ensures that sufficient air may enter the interior of the container as liquid is being drawn from the container. The mechanical venting assembly of this invention ensures that the vent openings associated therewith will not become plugged with debris.

2 Claims, 10 Drawing Sheets

(56) References Cited

U.S. PATENT DOCUMENTS

| | | | | |
|---|---|---|---|---|
| 6,299,037 | B1 | 10/2001 | Lee | |
| 6,364,163 | B1 | 4/2002 | Mueller | |
| 6,968,983 | B2 * | 11/2005 | Laible | 222/464.1 |
| 7,686,194 | B2 * | 3/2010 | Kasting | 222/549 |
| 8,083,107 | B2 * | 12/2011 | Laible | 222/478 |
| 2010/0213220 | A1 * | 8/2010 | Laible | 222/481.5 |
| 2010/0258593 | A1 * | 10/2010 | Laible | 222/478 |
| 2012/0104029 | A1 * | 5/2012 | Haas et al. | 222/1 |

* cited by examiner

SCREW-ON THROAT PLUG ASSEMBLY

BACKGROUND OF THE INVENTION

1. Field of the Invention

This invention relates to a screw-on throat plug assembly for use in a closed loop dispensing system or other types of dispensing systems and more particularly to a dispensing system for dispensing corrosive liquid chemicals or dangerous medical liquid products which are typically drawn from a container such as a bottle or the like to a mixing machine or the like. Even more particularly, this invention relates to a closed loop dispensing system including a mechanical venting means for a throat plug assembly which is screwed onto the throat of a liquid container.

2. Description of the Related Art

Corrosive liquid chemicals and dangerous medical liquid products are typically contained in a container such as a bottle or the like and are frequently dispensed therefrom to a mixing machine. Normally, a cap is placed on the bottle with a dip tube extending therefrom downwardly into the interior of the bottle for drawing the liquid upwardly thereinto. Normally, a dispensing tube extends from the cap to a mixing machine or to some other piece of equipment which creates suction in the dispensing tube to draw the liquid from the interior of the bottle.

Applicant has previously patented many closed loop dispensing systems with improved safety means and with improved venting. For example, see U.S. Pat. Nos. 5,988,456; 6,142,345; 6,968,983; and 8,083,107, the disclosures of which are incorporated herein by reference thereto to complete the disclosure, if necessary.

In Applicant's earlier U.S. Pat. No. 8,083,107 and in Applicant's other U.S. Pat. Nos. 6,968,983; 6,142,345; and 5,988,456, the throat plug assemblies thereof were press-fitted into the throats of the container. Although Applicant's earlier throat plug assemblies have met with considerable success, it has been found that the ability to threadably screw the throat plug assembly onto the externally threaded throat of the container is a distinct improvement over the throat plugs which were press-fitted into the throats of the containers. One disadvantage of the prior art throat plug assemblies is that the throat plug assemblies must be driven or forced downwardly into the throat of the container. Another disadvantage of the prior art throat plug assemblies is that it is difficult to remove the press-fitted throat plug assemblies from the throat of the container once the liquid therein has been dispensed from the container so that the container may be refitted and used again.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

This invention relates to a dispensing system for use with a container, such as a bottle or the like, having a hollow throat extending upwardly therefrom which has exterior and interior surfaces with the exterior surface of the throat having threads formed thereon. A throat plug assembly, having upper and lower ends, is positioned in the throat of the container and is threadably secured to the threads on the exterior surface of the throat of the container. The throat plug assembly of this invention, except for being threadably secured to the throat of the container, is similar to the throat plugs of Applicant's earlier U.S. Pat. Nos. 5,988,456; 6,142,345; 6,968,983 and especially U.S. Pat. No. 8,083,107 which includes a mechanical valve and venting assembly which is incorporated into the throat plug assembly of this invention.

A screw-on throat plug assembly of this invention is provided for use with a liquid container, having upper and lower ends, and a hollow throat extending upwardly therefrom at the upper end thereof which has an exterior outer threaded surface.

A throat plug assembly is positioned in the hollow throat of the container which is threadably secured to the threaded exterior surface of the hollow throat of the container. The throat plug assembly has upper and lower ends. The throat plug assembly includes a vertically disposed hollow valve body which has upper and lower ends. The lower end of the valve body has a hollow dip tube support extending downwardly therefrom. A dip tube is in communication with the dip tube support and the interior of a liquid container. The upper end of the hollow valve body is closed. The hollow valve body has at least one opening formed therein below the upper end thereof. A mechanical valve is movably mounted on the valve body and is movable between upper and lower positions with respect to the valve body. The mechanical valve, when in the upper position, closes the opening formed in the hollow valve body below the upper end thereof. The mechanical valve, when in the lower position, is positioned below the opening formed in the valve body. A spring means is associated with the throat plug assembly which yieldably maintains the mechanical valve in its upper position.

Rather than the throat plug assembly being press-fitted into the throat of the container, the throat plug assembly is threadably secured to the exterior threads of the throat of the container. The throat plug assembly is normally closed but will be opened when a connector cap or the like is secured thereto which causes the downward movement of the valve of the throat plug assembly to permit liquid to pass outwardly through the opening in the upper end of the valve body.

When the bottle and the throat plug assembly is being shipped, the upper end of the throat plug assembly is closed by a selectively removable lid or cover.

The fact that the throat plug assembly is selectively removably secured to the exterior threads of the container eliminates the need for press-fitting a throat plug assembly into the throat of the container.

It is therefore a principal object of the invention to provide a screw-on throat plug assembly for use in a closed loop dispensing system or other types of dispensing systems.

A further object of the invention is to provide a screw-on throat plug assembly for use with a container having liquid chemicals therein.

A further object of the invention is to provide a screw-on throat plug assembly which is easily secured to a container and which is easily removed from the container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
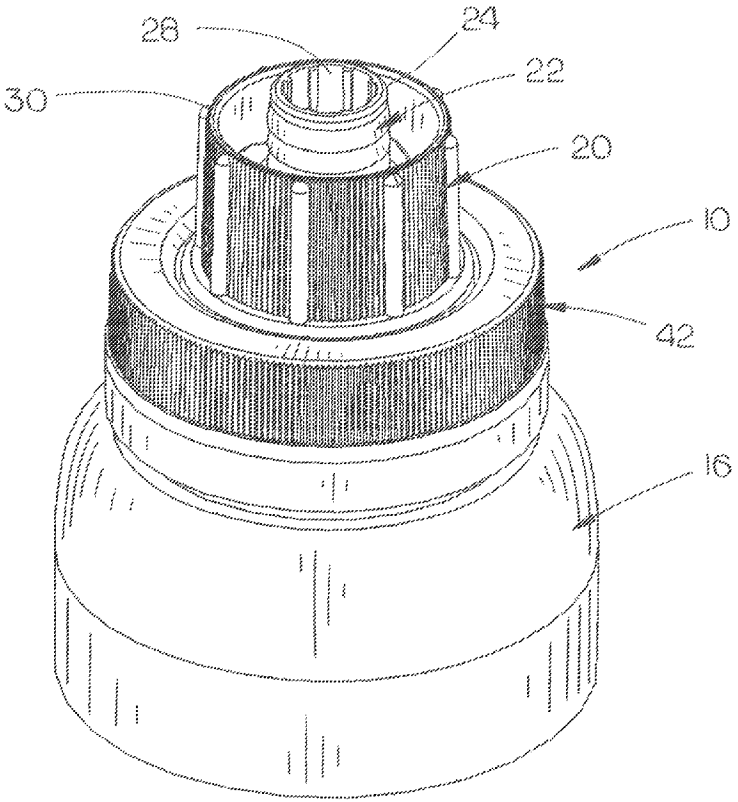
FIG. 1 is a perspective view illustrating the screw-on throat plug assembly of this invention attached to a liquid container with the liquid container being partially shown.
Figure 2:
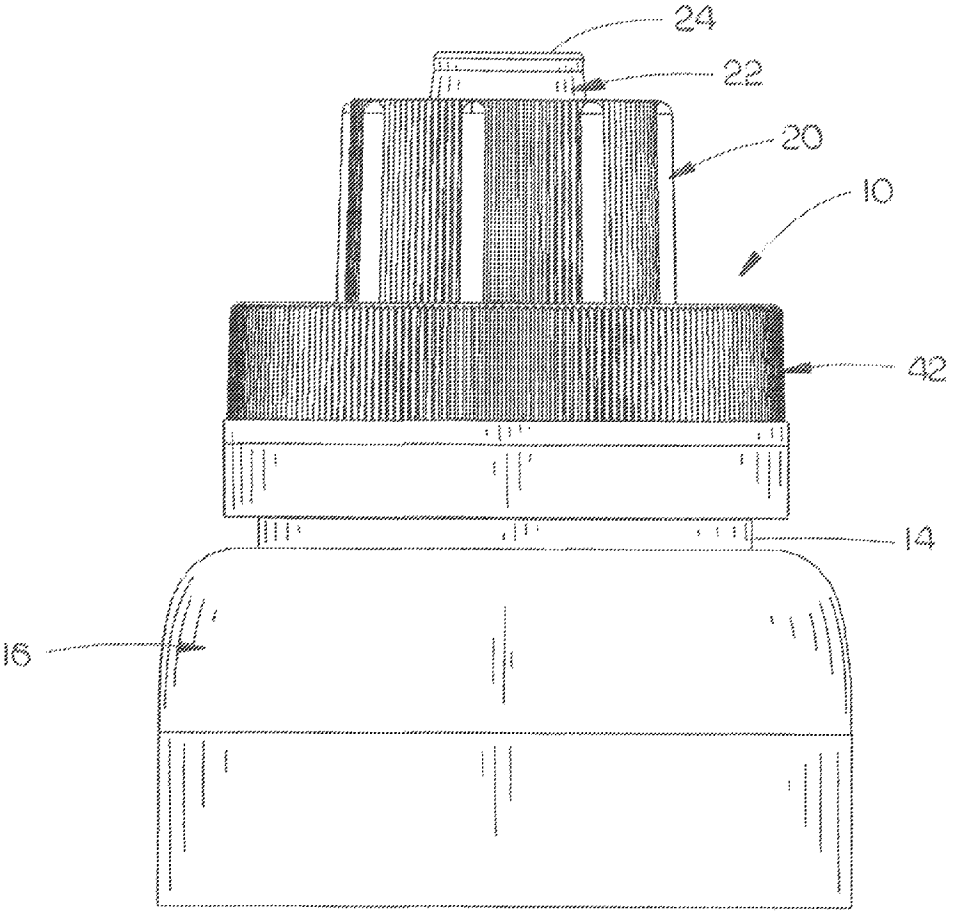
FIG. 2 is a side view illustrating the screw-on throat plug assembly of this invention attached to a liquid container with the liquid container being partially shown.
Figure 3:
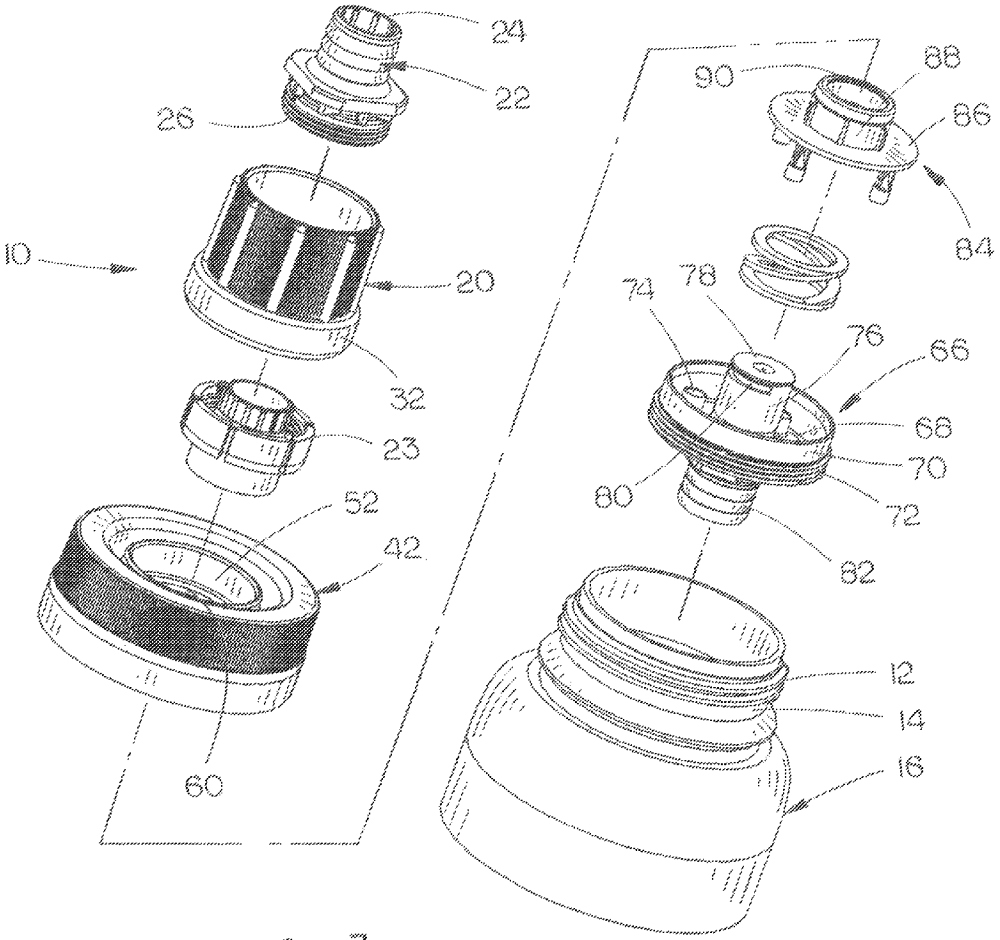
FIG. 3 is an exploded perspective view of the throat plug assembly of this invention, with the liquid container to which it will be attached, being partially shown.
Figure 4:
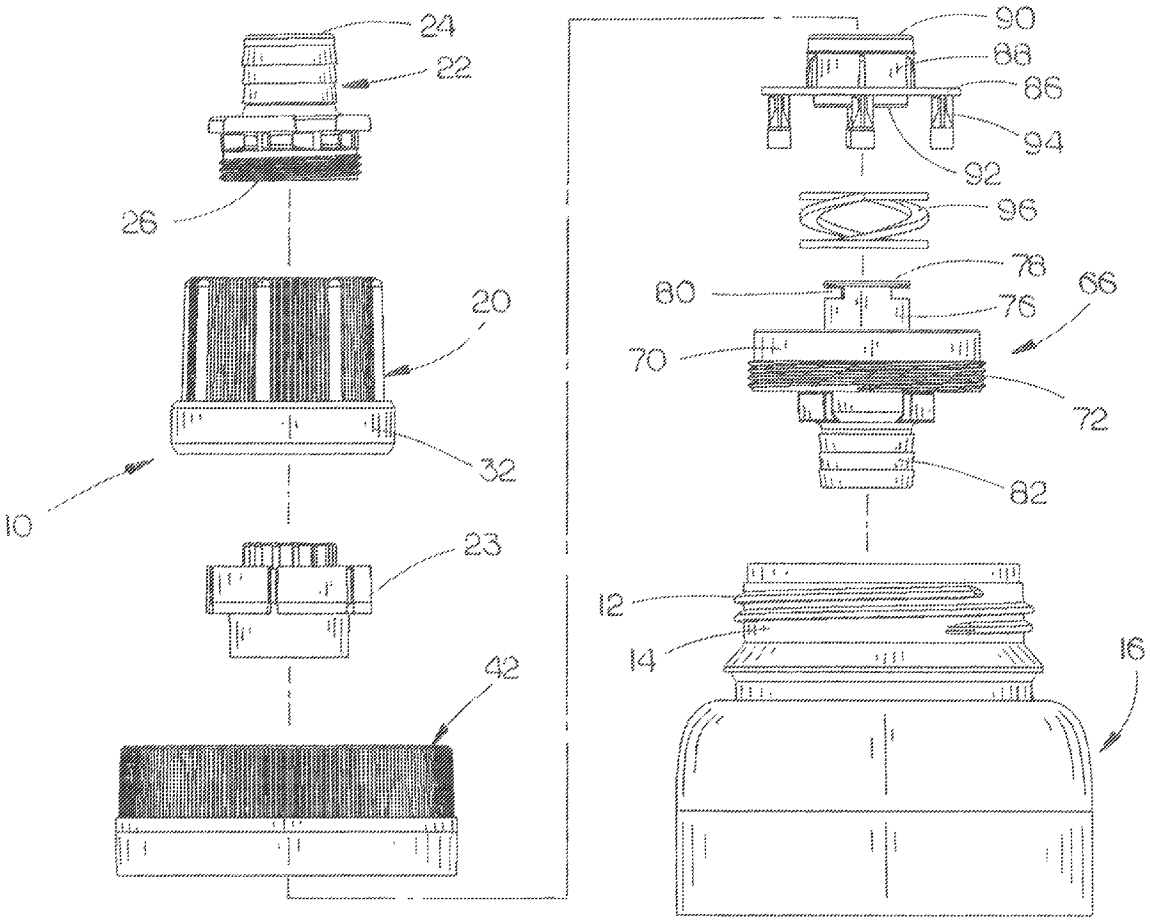
FIG. 4 is an exploded side view of the throat plug assembly of this invention, with the liquid container to which it will be attached, being partially shown.
Figure 5:
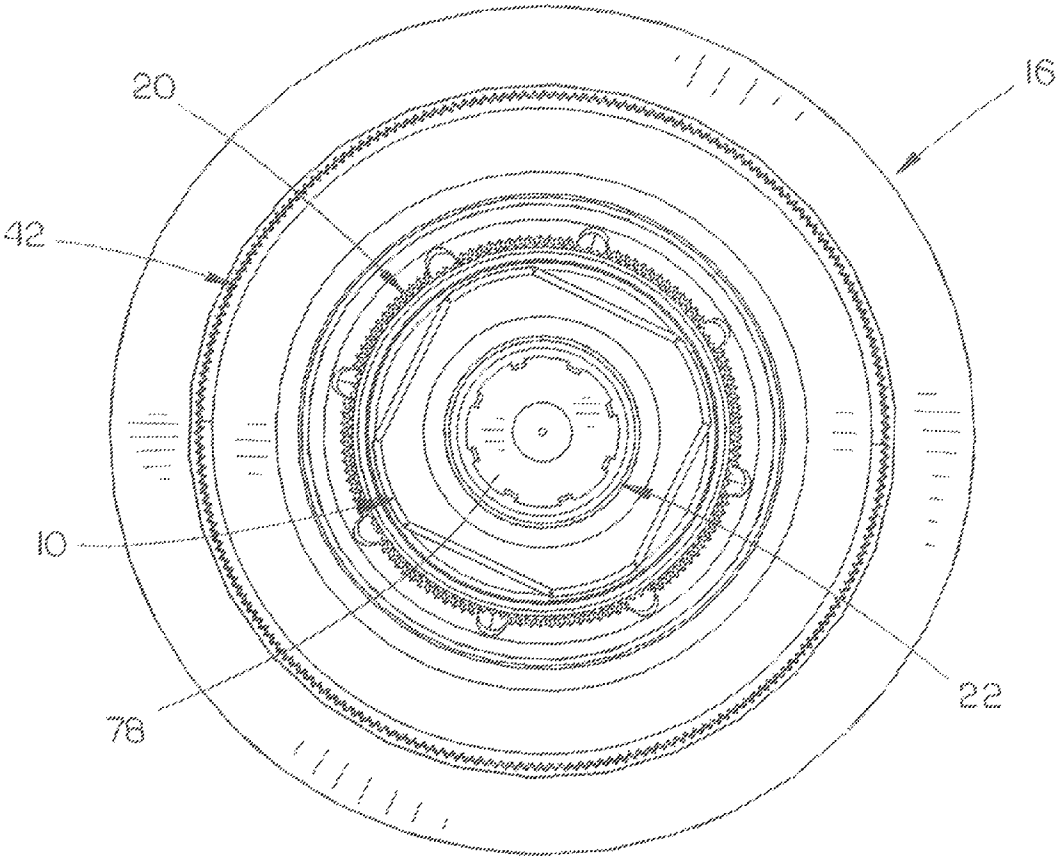
FIG. 5 is a top view of the throat plug assembly of this invention, with the liquid container to which it will be attached, being partially shown.
Figure 6:
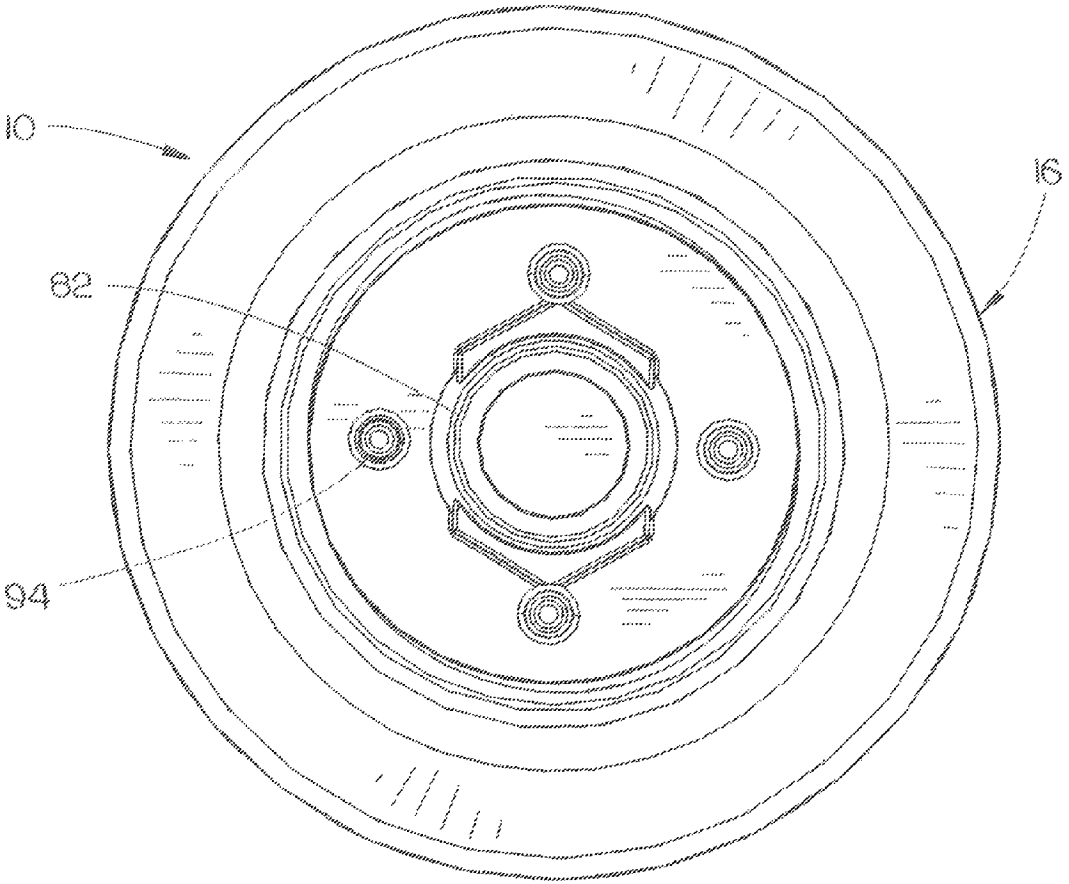
FIG. 6 is a bottom view of the throat plug assembly of this invention, with the liquid container to which it will be attached, being partially shown.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the throat plug assembly of this invention which is threadably secured onto the external threads 12 of the throat 14 of a liquid container 16. In the drawings, the container 16 is only partially shown. The numeral 18 refers to a shipping lid or cover which will be threadably secured to the throat plug assembly 10 to enable the container 16 to be shipped with the throat plug assembly 10 screwed onto the throat 14 of the container 16, as will be described in more detail hereinafter.

Figure 7:
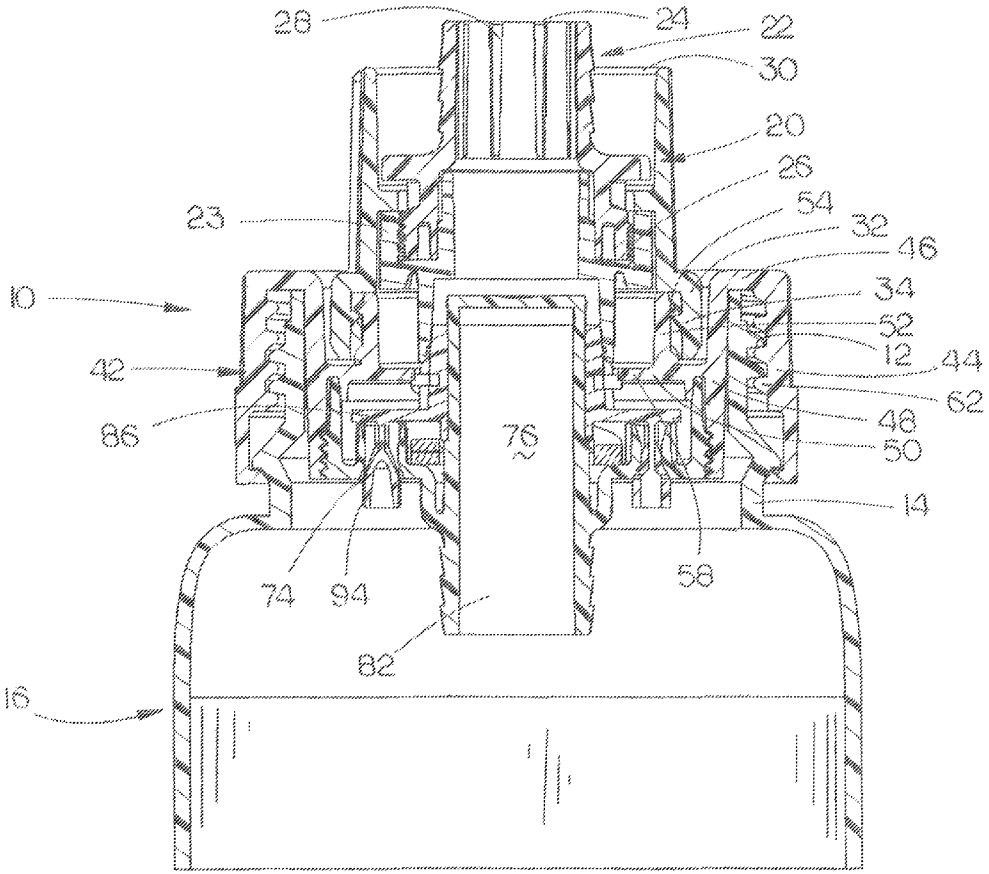
FIG. 7 is a sectional view of the throat plug assembly of this invention, with the liquid container to which it will be attached, being partially shown.
Figure 8:
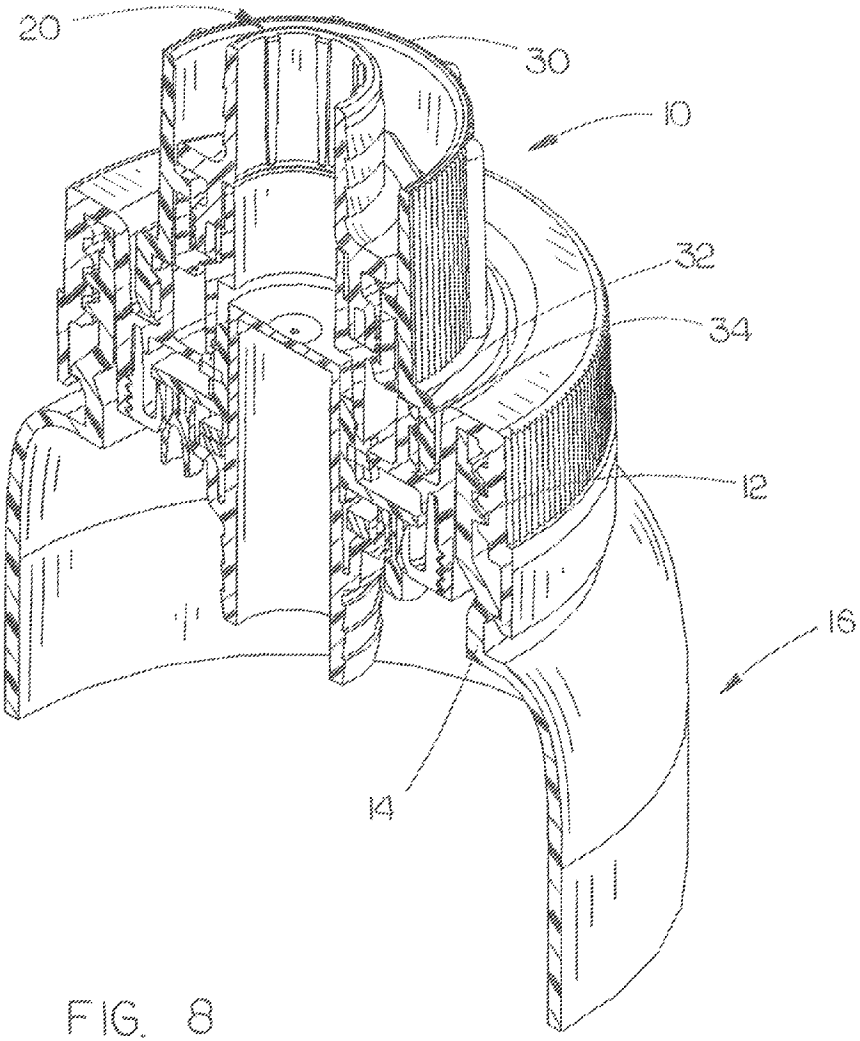
FIG. 8 is a perspective sectional view of the throat plug assembly of this invention, with the liquid container to which it will be attached, being partially shown.
Figure 9:
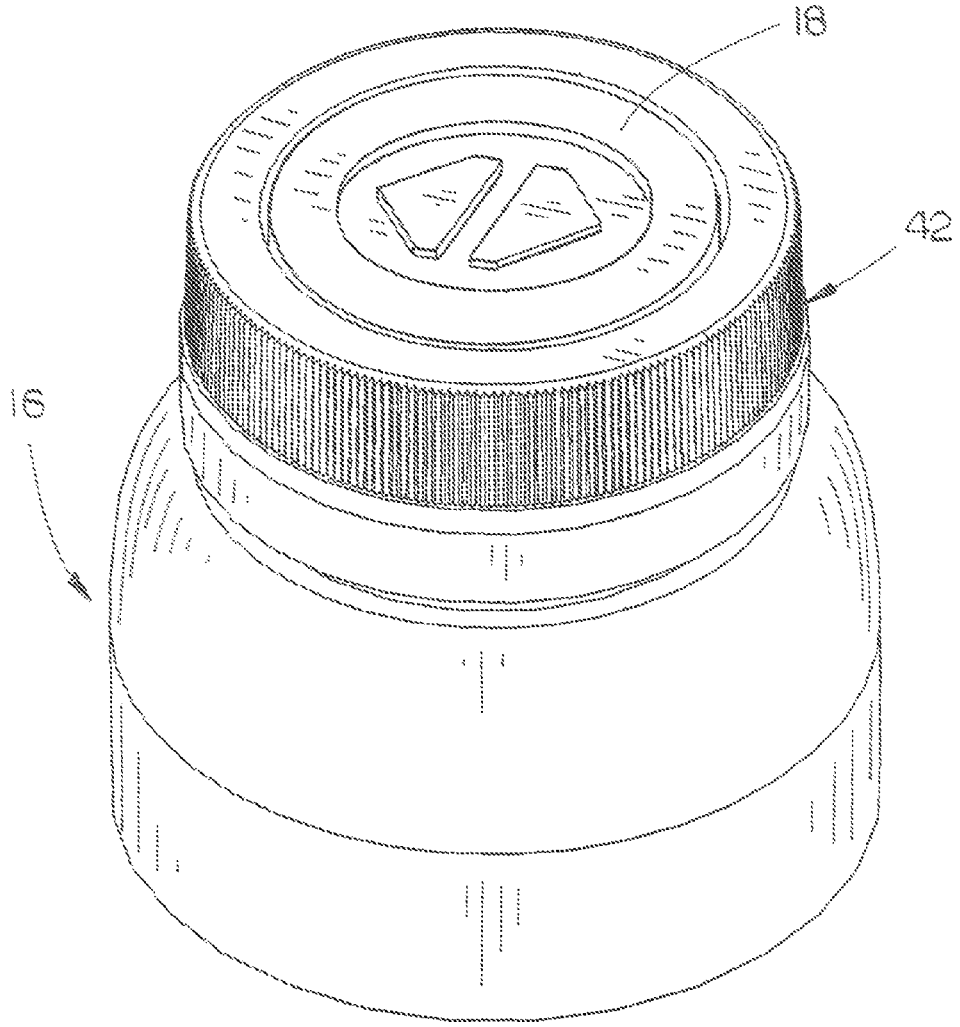
FIG. 9 is a perspective view illustrating the shipping lid mounted on the screw-on throat plug assembly of this invention with the container being partially shown.
Figure 10:
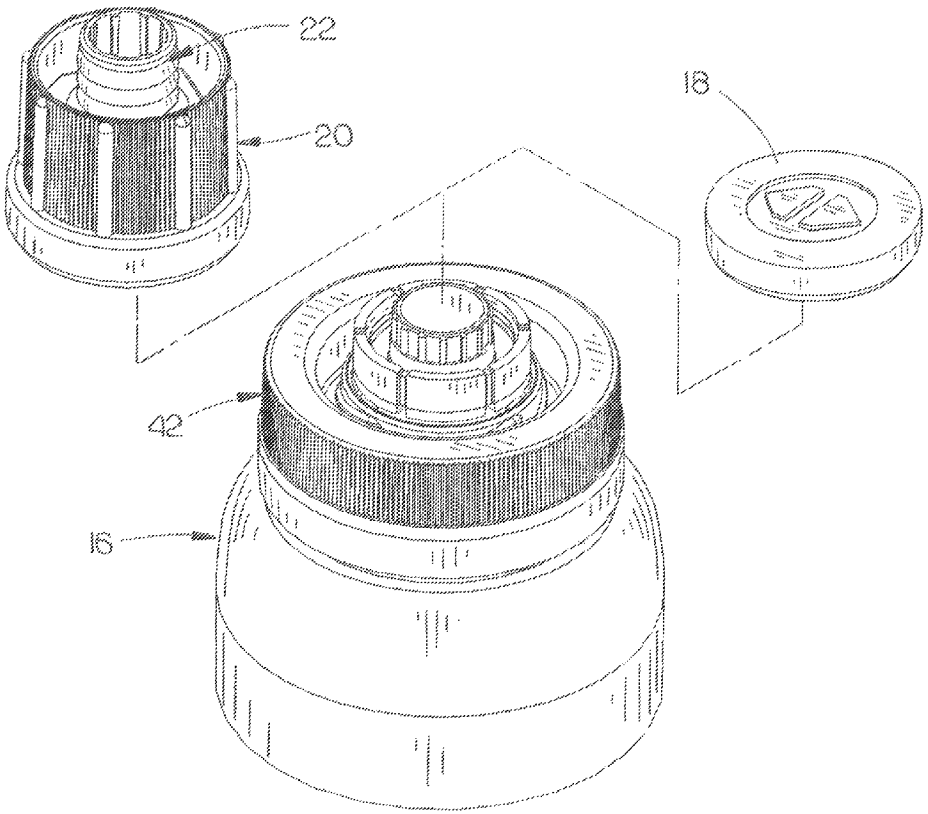
FIG. 10 is an exploded perspective view illustrating the manner in which shipping lid may be secured to the screw-on throat plug assembly when the connector cap is disconnected from the container and vice versa.

The numeral 20 refers to a connector cap which will be used during the time that liquid is being drawn from the container 16 as will be described in more detail hereinafter. The connector cap 20 may have a tube support 22 centrally positioned therein and held therein by a member 23 threadably secured thereto as seen in FIG. 7, or an internally threaded cylindrical or tubular member, each of which have an upper end 24 and a lower end 26. If the cylindrical member is used, it will be normally molded with the cap 20. In either case, the tube support 22 or cylindrical member will have a central opening 28 formed therein. Cap 20 has an upper end 30 and an enlarged lower end 32 which has internal threads 34.

Throat plug assembly 10 includes a screw-on cap 42 having an outer wall 44, with inner and outer surfaces, a top wall 46, an inner wall 48 extending downwardly from top wall 46, a horizontally disposed wall portion 50 extending inwardly from inner wall 48, and an upstanding wall 52 having an externally threaded portion 54. A horizontally disposed and ring-shaped wall 58 extends inwardly from wall portion 52 which has a central opening 60 formed therein. The inner side of outer wall 44 has threads 62 formed therein. The inner side of the lower end of wall 52 has threads 64 formed thereon.

The numeral 66 refers to a valve body support including an upstanding, ring-shaped and horizontally disposed wall 68 which has an upstanding wall 70 extending upwardly therefrom at the periphery thereof. Wall portion 70 has an externally threaded portion 72 at the lower end thereof. Wall 68 has a plurality of vent openings 74 formed therein, as seen in the drawings. A vertically disposed and hollow valve body 76 is positioned in the center of wall 68 and has a closed upper end 78. One or more openings 80 are formed in the upper side wall of valve body 76 below the closed upper end 78 thereof. The lower end of valve body 76 forms a dip tube support 82.

The numeral 84 refers to a mechanical valve and vent assembly. Assembly 84 includes a horizontally disposed disc 86 having a vertically disposed tubular valve 88 having an upper end 90 disposed above disc 86 and a lower end 92 disposed below disc 86. A plurality of vent pins 94 are secured to the under side of disc 86 and extend downwardly therefrom for reception in the vent openings 74 as disclosed in U.S. Pat. No. 8,683,107. Valve 88 slidably embraces the upper end of valve body 76 and is movable between an upper position and a lower position. In its upper position, the upper end of valve 88 closes the openings 80 in valve body 76. In its lower position, the upper end 90 of valve 88 is positioned below openings 80. A plastic spring 96 has its lower end positioned on the upper side of wall 78 and has its upper end embracing lower end 92 so as to engage the underside of disc 86 to yieldably urge the valve 88 to its upper position.

In use, when the container 16 is being shipped from its place of manufacture to a distributor or user, the shipping cap or lid 18 will be threadably secured to the upper end of the throat plug assembly 10.

When the container 16 is desired to be placed in operation, the shipping lid 18 is removed therefrom and the screw-on cap 42 is threadably secured to the external threads 12 of the container 16. The connector cap 20 is then threadably secured to cap 42. The connector cap 20 will be in communication with a mixing machine, etc. which creates suction in valve body 76 so that liquid in the container is drawn upwardly through the throat plug assembly as in the above-identified patents. As the connector cap 20 is threadably tightened onto the threads 12 of the container 16, valve 88 will be moved downwardly with respect to valve body 76 to expose the opening or openings 80 so that liquid may pass therethrough and outwardly through the cap to the mixing machine or other device. The above-identified patents of Applicant are incorporated herein by reference thereto to complete this disclosure if necessary.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A screw-on throat plug assembly for use with a liquid container, having upper and lower ends, and a hollow throat extending upwardly at the upper end thereof which has an interior surface and a threaded outer surface, comprising:

a throat plug assembly;

said throat plug assembly having upper and lower ends;

said throat plug assembly including a screw-on cap at said upper end thereof having a vertically disposed outer wall having a threaded inner surface and an outer surface, a top wall extending horizontally inwardly from said upper end of said vertically disposed outer wall, a vertically disposed inner wall extending downwardly from said top wall in a spaced-apart relationship with respect to said outer wall;

said threaded inner surface of said outer wall of said throat plug assembly being threadably secured to the threaded outer surface of the hollow throat of the liquid container;

said throat plug assembly, except for said outer wall and said top wall of said screw-on cap, being completely positioned within the hollow throat of the liquid container;

said throat plug assembly including a vertically disposed hollow valve body which has upper and lower ends;

said lower end of said valve body having a hollow dip tube support extending downwardly therefrom;

a dip tube in communication with said dip tube support which is in communication with the liquid in the container;

said upper end of said hollow valve body being closed;

said hollow valve body having at least one opening formed therein below said upper end thereof;

a mechanical valve movably embracing at least a portion of said valve body;

said mechanical valve being movable between upper and lower positions with respect to said valve body;

said mechanical valve, when in said upper position, closing the opening formed in said hollow valve body below the upper end thereof;

said mechanical valve, when in said lower position, being positioned below the opening formed in said valve body;

a spring means in said throat plug assembly which yieldably maintains said mechanical valve in said upper position; and a shipping cover means threadably secured to said throat plug assembly above said upper end of said valve body which does not engage said mechanical valve.

2. A screw-on throat plug assembly for use with a liquid container, having upper and lower ends, and a hollow throat extending upwardly at the upper end thereof which has an interior surface and a threaded outer surface, comprising:

a throat plug assembly;

said throat plug assembly having upper and lower ends;

said throat plug assembly including a screw-on cap at said upper end thereof having a vertically disposed outer wall having a threaded inner surface and an outer surface, a top wall extending horizontally inwardly from said upper end of said vertically disposed outer wall, a vertically disposed inner wall extending downwardly from said top wall in a spaced-apart relationship with respect to said outer wall;

said threaded inner surface of said outer wall of said throat plug assembly being threadably secured to the threaded outer surface of the hollow throat of the liquid container;

said throat plug assembly, except for said outer wall and said top wall of said screw-on cap, being completely positioned within the hollow throat of the liquid container;

said throat plug assembly including a vertically disposed hollow valve body which has upper and lower ends;

said lower end of said valve body having a hollow dip tube support extending downwardly therefrom;

a dip tube in communication with said dip tube support which is in communication with the liquid in the container;

said upper end of said hollow valve body being closed;

said hollow valve body having at least one opening formed therein below said upper end thereof;

a mechanical valve movably embracing at least a portion of said valve body;

said mechanical valve being movable between upper and lower positions with respect to said valve body;

said mechanical valve, when in said upper position, closing the opening formed in said hollow valve body below the upper end thereof;

said mechanical valve, when in said lower position, being positioned below the opening formed in said valve body;

a spring means in said throat plug assembly which yieldably maintains said mechanical valve in said upper position; and a connector cap means selectively threadably secured to said upper end of said throat plug assembly;

said connector cap means, when threadably secured to said throat plug assembly, causing said mechanical valve to move from said upper position to said lower position so that said opening in said valve body is in liquid communication with said connector cap means.

* * * * *